US009285199B2

(12) United States Patent
Beikoff

(10) Patent No.: US 9,285,199 B2
(45) Date of Patent: Mar. 15, 2016

(54) SHELL FOR EXPLOSIVE

(71) Applicant: ORICA INTERNATIONAL PTE LTD

(72) Inventor: Bradley Kevin Beikoff, Karana Downs (AU)

( * ) Notice: Subject to any disclaimer, the term of this patent is extended or adjusted under 35 U.S.C. 154(b) by 0 days.

(21) Appl. No.: 14/388,730

(22) PCT Filed: Mar. 20, 2013

(86) PCT No.: PCT/AU2013/000275
§ 371 (c)(1),
(2) Date: Sep. 26, 2014

(87) PCT Pub. No.: WO2013/142894
PCT Pub. Date: Oct. 3, 2013

(65) Prior Publication Data

US 2015/0053105 A1 Feb. 26, 2015

(30) Foreign Application Priority Data

Mar. 28, 2012 (AU) ..... 2012901264

(51) Int. Cl.
*F42B 3/26* (2006.01)
*F42C 19/08* (2006.01)
*F24D 3/04* (2006.01)
(Continued)

(52) U.S. Cl.
CPC . *F42C 19/08* (2013.01); *F24D 3/04* (2013.01); *F42B 3/00* (2013.01); *F42B 3/26* (2013.01); *F42D 1/043* (2013.01)

(58) Field of Classification Search
CPC ..... F42D 1/18; F42B 3/00; F42B 12/76; F42B 3/26; F42B 3/08; F42B 3/10; F42B 33/0214; F42B 3/04; F42B 1/043; F42C 19/08
USPC ..... 102/314, 318, 319, 321, 321.1, 322, 102/327
See application file for complete search history.

(56) References Cited

U.S. PATENT DOCUMENTS 2,682,221 A * 6/1954 Sauvage ..... F42B 3/00 102/202.13
3,431,849 A * 3/1969 Kern ..... F42B 3/00 102/318

(Continued)

FOREIGN PATENT DOCUMENTS

| | | | |
|---|---|---|---|
| AU | 2007214365 | A1 | 4/2008 |
| CN | 102226669 | A | 10/2011 |
| EP | 2 177 866 | A1 | 4/2010 |

OTHER PUBLICATIONS

Written Opinion for International Patent Application No. PCT/AU2013/000275, mailed Apr. 11, 2013.

(Continued)

*Primary Examiner* — Troy Chambers
*Assistant Examiner* — Bridget Cochran

(57) ABSTRACT

A booster shell, comprising: an elongate body defining a chamber for an explosive composition, the body comprising an upper end and a lower end; an inlet at the upper end of the elongate body adapted to allow an explosive composition to be delivered into the chamber; a detonator receiving passage adapted to receive a detonator, the detonator receiving passage: (a) extending within the chamber from the upper end of the elongate body to the lower end of the elongate body; (b) being integrally formed with the elongate body; and (c) including a detonator stop at or near to the lower end of the elongate body; and a detonator lead guide adapted to receive the lead of a detonator, the detonator lead guide: (a) extending from the upper end of the elongate body to the lower end of the elongate body and (b) being integrally formed with the elongate body.

21 Claims, 10 Drawing Sheets

(51) Int. Cl.
*F42D 1/04* (2006.01)
*F42B 3/00* (2006.01)

(56) References Cited

U.S. PATENT DOCUMENTS 3,831,522 A * 8/1974 Romney ..... F42B 3/00 102/318
3,931,763 A * 1/1976 Bluhm ..... F42B 3/26 102/202.12
3,955,504 A * 5/1976 Romney ..... F42B 3/00 102/306
4,178,852 A * 12/1979 Smith ..... F42B 3/26 102/275.4
4,334,476 A * 6/1982 Day ..... F42B 3/00 102/275.12
4,637,312 A * 1/1987 Adams ..... F42B 3/26 102/275.12
4,945,808 A * 8/1990 Dowing ..... F42D 1/04 102/315
5,763,816 A * 6/1998 Keeling ..... F42B 3/00 102/275.11
6,112,666 A * 9/2000 Murray ..... F42D 1/043 102/275.12
2014/0345486 A1 * 11/2014 Most ..... F42B 3/26 102/322

OTHER PUBLICATIONS

Supplementary Search Report for European Patent Application No. 13769810.6, mailed Feb. 10, 2015.

* cited by examiner

SHELL FOR EXPLOSIVE

CROSS-REFERENCES TO RELATED APPLICATIONS

This application is a U.S. national phase application of International PCT Patent Application No. PCT/AU2013/000275, which was filed on Mar. 20, 2013, which claims priority to Australian Patent Application No. 2012901264, filed Mar. 28, 2012. These applications are incorporated herein by reference in their entireties.

TECHNICAL FIELD

The present invention relates to shell for an explosive charge. More specifically, the present invention relates to a shell for a booster. The invention also relates to a booster produced using the shell, to the booster when primed with a detonator and to a method of blasting using the booster.

BACKGROUND

In commercial mining applications blast holes are drilled, loaded with bulk explosive and the bulk explosive initiated. This is typically done using a so-called booster. This is a separate, relatively small explosive charge that is housed in a shell that is designed to receive a detonator. The detonator typically takes the form of a cylindrical cartridge and includes a base charge at one end. A lead (for signal transmission to fire the detonator) extends from the other end of the detonator. In use, a detonator is inserted into the booster, the booster is positioned in a blast hole and surrounded by bulk explosive. The detonator is then fired thereby triggering detonation of the explosive charge of the booster. In turn, that causes detonation of the bulk explosive.

Manufacture of a booster typically involves casting a molten explosive composition (usually Pentolite) in a suitably designed shell. The explosive composition is typically cast (poured) around metal (e.g. brass) pins suitably positioned within the cavity defined by the booster shell. After the explosive composition has solidified these pins are removed to provide tunnels (passages) that are adapted to receive a detonator. These cast boosters typically have at least two such detonator tunnels extending through the cast composition to allow a detonator to be fed fully down through one tunnel and return up through the other which will have a blind end or stepped end which functions as a stop position for the end of the detonator. The detonator lead (extending out of the top of the booster) is then pulled taut and the booster with detonator (primed booster) is ready to be positioned in a blast hole.

A problem that has been observed with this form of booster design is that as the cast explosive cools and solidifies it shrinks (the shrinkage rate is approximately 7 volume %) and this results in the composition developing shrinkage voids at its upper end, i.e. at the top of the booster. These shrinkage voids can lead to unreliable initiation of the booster because, when loaded in the booster, the detonator is oriented such that the base charge of the detonator is located towards the top of the booster and thus in proximity to any shrinkage voids that will be present. The presence of the voids tend to impair communication of energy from the base charge of the detonator to the cast explosive in the booster, thereby leading to unreliable initiation of the booster.

This problem can be mitigated by minimising the amount of voids present in the cast explosive composition, for example, by casting the explosive composition in stages with at least partial cooling of the composition being allowed between casting stages. In this way voids formed as the composition solidifies can be filled in a subsequent casting stage. However, this multi-stage approach to casting comes at the expense of productivity. The use of metal pins to define the detonator tunnels during casting also adds another step to the manufacturing process.

Against this background it would be desirable to adopt a different approach to the manufacture and use of cast boosters that does not suffer the operational and manufacturing issues noted above.

SUMMARY OF THE INVENTION

Accordingly, the present invention provides a booster shell, which comprises:

an elongate body defining a chamber for an explosive composition, the body comprising an upper end and a lower end;

an inlet at the upper end of the elongate body that is adapted to allow an explosive composition to be delivered into the chamber;

a detonator receiving passage that is adapted to receive a detonator, the detonator receiving passage: (a) extending within the chamber from the upper end of the elongate body to the lower end of the elongate body; (b) being integrally formed with the elongate body; and (c) including a detonator stop at or near to the lower end of the elongate body; and a detonator lead guide that is adapted to receive the lead of a detonator, the detonator lead guide: (a) extending from the upper end of the elongate body to the lower end of the elongate body and (b) being integrally formed with the elongate body.

The invention also provides a method of making a cast booster by casting a suitable explosive composition in the booster shell of the invention. This is done by delivering molten explosive composition into the chamber of the shell via the inlet at the upper end of the shell. Casting per se is carried out in conventional manner using known compositions and methodology, although it should be emphasised that casting is carried in a single stage. Multi-stage casting is not required.

After the explosive composition has solidified the booster can be primed with a detonator. Conventional cartridge detonators are used. Priming involves insertion of the detonator into the detonator receiving passage from the upper end of the body until the end of the detonator abuts against the stop in the passage. The detonator leads will extend out of the passage and can be accommodated by the detonator lead guide. Depending upon design, it may be necessary to feed the detonator through the detonator lead guide before inserting it into the detonator receiving passage, and this will be discussed in more detail later. The present invention also relates to a primed booster.

Once primed the detonator can be inserted into a blast hole. This is done by "inverting" the booster and feeding it lower end (of the booster body) first into the hole, with the detonator leads extending out of the hole. Bulk explosive can then be delivered into the blast hole and the blast initiated in conventional manner. Consistent with this embodiment the present invention provides a method of blasting which comprises associating a primed booster (in accordance with the invention) with a bulk explosive in a blast hole, and initiating the primed booster by firing of the detonator in the primed booster.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

BRIEF DISCUSSION OF THE DRAWINGS

Embodiments of the present invention are illustrated with reference to the accompanying non-limiting drawings in which.

DETAILED DISCUSSION OF THE INVENTION

Figure 1:
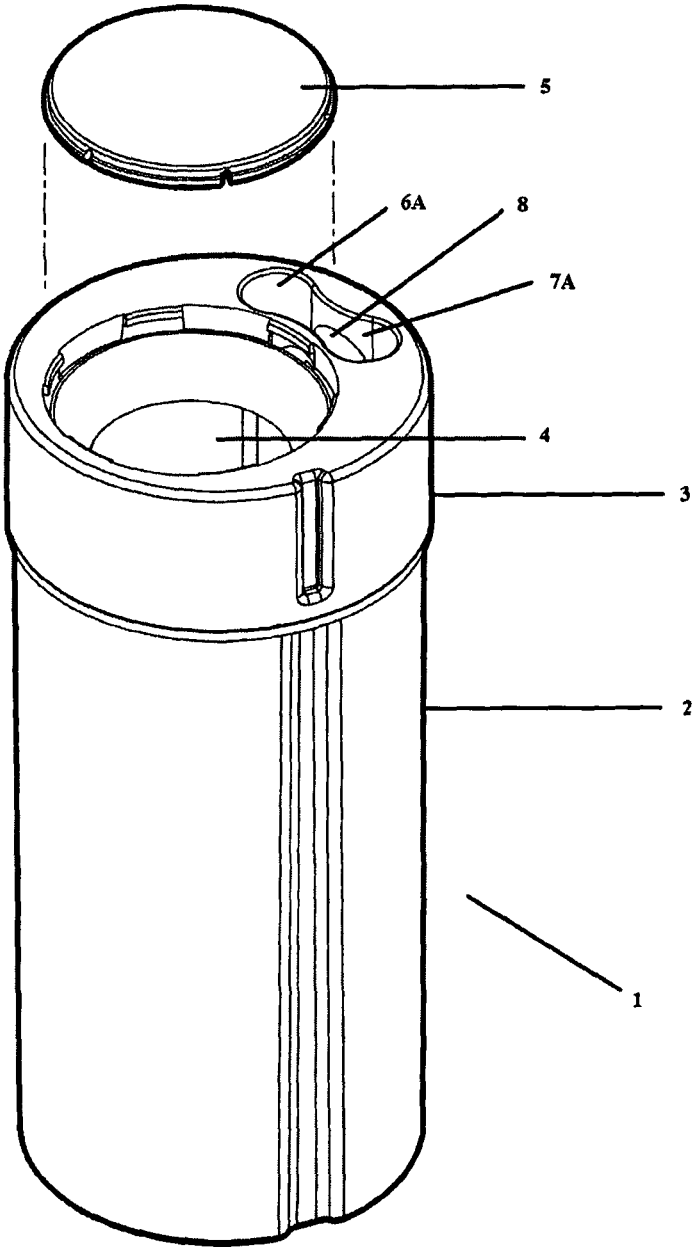
FIGS. 1-6 illustrate booster shells, and components of booster shells, in accordance with the present invention.

In accordance with the present invention the design of the detonator receiving passage of the booster shell means that, on priming, the end of the detonator that includes a base charge will be remote from the upper end of the shell. However, as the explosive composition contained in the booster shell is delivered (cast) into the shell via an inlet at the upper end of the shell, any voids in the explosive composition as a result of shrinkage during solidification will be located at or close to the upper end of the shell. What this means is that there should not be any voids in the cast composition in proximity to the base charge of the detonator. The voids would be present at the upper end of the shell, whereas the base charge of the detonator would be at or close to the lower end of the shell. This avoids the problem highlighted above of unreliable booster initiation. It will be appreciated that the design of the booster shell of the invention enables this desirable outcome.

It is also relevant to note that the detonator receiving passage and detonator lead guide are integrally formed with the body of the booster shell. This enables the casting of explosive composition in the shell to be simplified when compared with the conventional methodology of needing to use removable metal pins to define suitable channels within the cast explosive itself. In the present invention the detonator receiving passage and detonator lead guide are defined by structural features of the shell rather than of the cast explosive composition.

The booster shell of the invention is formed by injection moulding of a plastic material (for example polyethylene or polypropylene) into a suitably configured die/mould. This enables various advantageous design features to be achieved, especially as integrally formed features.

Outer walls of the booster shell should sufficiently thick and robust to withstand intended use. Structures internal to the shell may be formed of thin walls or webs of polymer, although it should be noted that various structures of the shell will come into contact with molten explosive composition during casting of explosive composition into the shell. Materials selection, wall/web thicknesses and design will need to take this into account.

The design of the booster shell should take into account costs and ease of manufacture, as well as ease and practicality of use. To simplify manufacture and assembly it is desirable that the booster shell is made up of the minimum number of component parts. In an embodiment the booster shell is injection moulded as a single piece with the various design features integral to that moulding. In other embodiments the booster shell is made up of a number of simple components that are each injection moulded and that can be assembled with ease to provide a booster shell having the requisite design features. This may offer greater flexibility of design without complicating manufacturing and assembly. The various components may be adapted to be secured together by screwing or by friction fit.

The booster shell of the invention comprises an elongate body portion that defines a chamber. This chamber will house the explosive composition of the booster. The body portion is typically cylindrical (typically the diameter is 30-70 mm). The booster shell is intended to receive and fully enclose a detonator and it is therefore typically 110-140 mm in length. The dimensions of the booster shell may be varied depending upon the energy release, and thus the volume of explosive composition, required. By way of example, the mass of explosive composition contained in the shell may be 50-900 grams.

The booster shell includes at its upper end an inlet which enables explosive composition to be delivered into the chamber. This will invariably be done by pouring or injecting molten explosive composition (Pentolite for example) through the inlet. The inlet will usually include a cap or bung. This may be secured into the inlet by screw fitting or by friction fit. It is preferred that the entire explosive composition is fully enclosed to reduce exposure to operators and the potential for unintended friction or impact events which could accidentally detonate the explosives.

The booster shell comprises a detonator receiving passage that is adapted to receive a detonator. The passage is intended to fully enclose a detonator along its length and will be sized accordingly. The passage is provided within the chamber defined by the elongate body and extends from the upper end to the lower end of the elongate body. The passage is open at the upper end of the elongate body (booster shell) and includes a detonator stop at or near to the lower end of the passage. This stop may extend fully or partially across the diameter of the passage provided it serves its intended function. The stop may be integral with the passage or it may be a separate component that can be fitted into the end of the passage.

In a preferred embodiment, the end of the detonator receiving passage remote from the detonator stop will include at its upper end a detonator retention means that prevents a detonator inserted into the passage from unintentionally falling out or from being withdrawn, for example when the detonator lead is put in tension as is likely when a primed booster is being loaded in a blast hole. The retention means may comprise a series of (resilient) tabs that extend inwardly across the passage or the inlet to the passage. These tabs are deflected downwardly as the detonator is pushed into the passage and return to their original position after the other end of the detonator has been inserted beyond the tabs.

The booster shell also comprises a detonator lead guide. The function of this is to accommodate the lead of a detonator that is loaded into the booster during priming. The guide may be provided on the outside of the shell, although preferably the guide is provided within the shell as this provides greater protection to the detonator lead. The guide extends from the upper end to the lower of the elongate body, and is usually provided parallel and immediately adjacent to the detonator receiving passage. In an embodiment of the invention priming involves insertion of a detonator into and through the detonator lead guide from below, with the detonator then being inserted and down into the detonator receiving passage. When the guide is intended to allow detonator loading in this way, the diameter of the guide will be sized accordingly. A detonator lead recessed return may be provided between the open ends of the detonator lead guide and the detonator receiving passage. This return may take the form of a "saddle".

Notably the detonator receiving passage and detonator lead guide are each integrally formed with the elongate body of the booster shell. This simplifies manufacture and means that these structures are not formed by moulding of explosive composition around metal pins, as described above.

With respect to the walls defining the detonator receiving passage, if these are too thick this may reduce the ability for a detonator to initiate the booster composition, so it is desirable to have the relevant walls as thin as possible. The walls defining the passage can however be subject to distortion by hot explosive composition during casting. To mitigate this, the detonator receiving passage and detonator lead guide are integral with or attached to a wall of the booster shell. This will provide enhanced structural support to the passage and guide.

It is also preferred that the detonator receiving passage and/or detonator lead guide are integral with the (inner) wall of the booster shell along the entire length of the passage and/or guide. This simplifies mould design and allows walls defining the passage and/or guide to be moulded very thin. This design implies a mould design such that during injection moulding plastic flows along those parts of the mould defining the walls of booster shell while at the same time filling those parts of the mould that define the passage and/or guide. This would not occur if the mould cavities defining the passage and guide were fed from one end only during injection moulding. Preferably, the detonator receiving passage and detonator lead guide are integral with the (inner) wall of the booster shell along the entire length of the passage and guide.

In use hot explosive is cast in the booster shell. After cooling the inlet through which the explosive has been delivered into the shell is closed. Importantly, any voids in the cast composition will be located at the upper end of the cast composition and thus at the upper end of the booster. If the detonator receiving passage does not include an integral detonator stop, a suitable stop is provided in the passage as a separate component as has been described. A detonator can then be inserted into the detonator receiving passage noting here that the base charge at the end of the detonator will be located remote from the end of the booster where any shrinkage voids in the composition will be present. The detonator lead is positioned in the detonator lead guide, the lead extending from the lower end of the booster. On loading into a blast hole, the primed booster is "inverted" and delivered upper end first into a blast hole with the detonator lead extending out of the blast hole. The blast hole can then be charged with bulk explosive. This bulk explosive is initiated using the booster, the booster itself being initiated by the detonator enclosed in it.

In an embodiment of the invention the booster may include a (small) separate sensitiser explosive charge to increase initiation sensitivity. This may be necessary if the (cast) explosive charge contained in the booster is less sensitive to being initiated. A separate sensitiser charge may also be of use depending upon the thickness of plastic wall members (defining the detonator receiving passage, for example) between the base charge of the detonator and the explosive charge contained in the booster. The presence of such wall members can reduce the energy communicated to the explosive charge in the booster when the detonator is fired. In these cases the use of a separate sensitising charge within the booster may be beneficial.

In this embodiment the sensitiser explosive charge may be incorporated into the booster in a sealed and thin-walled container. For example, loose PETN may be contained inside a blow moulded thin-walled plastic bottle which is positioned in the booster shell before casting. The container should be positioned at the lower end of the shell and close to, or in contact with, the wall of detonator receiving passage.

Incorporating a separate sensitising charge in the booster may also render the booster capable of being initiated by use of detonating cord rather than a detonator. In this case low strength detonating cord would typically be used (with a core loading down to about 3.6 g/m). In this embodiment a length of the detonating cord should be provided inside the booster (in the detonator receiving passage and, possible, the detonator lead guide) in close proximity to the separate sensitising charge. How the detonating cord is fed into the booster will depend upon the design of this passage and guide. After priming with detonating cord, the booster is then oriented in a blast hole as described above in relation to a detonator-primed booster.

Embodiments of the invention are discussed below with reference to the accompanying non-limiting drawings.

Figure 2:
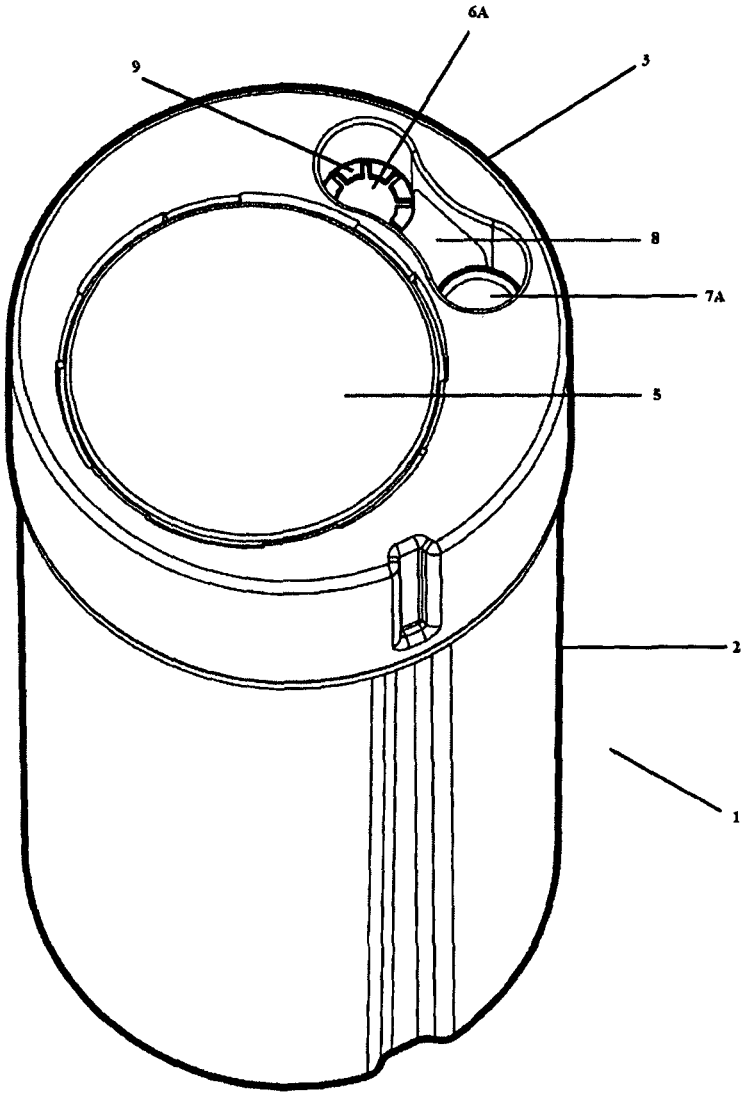

FIGS. 1 and 2 shows a booster shell (1) in accordance with the invention. In the embodiment shown the shell (1) is assembled from of a number of components. Thus, the shell comprises an elongate body portion (2) that defines a chamber (or internal cavity) for an explosive charge. Onto the body portion (2) is fitted (by screwing or friction fit) a top cap (3). The top cap (3) includes an inlet (or filler, port) (4) through which molten explosive composition is delivered into the shell (3). The inlet (4) can be sealed with a screw-fitting or friction fit cap (or filler port bung) (5). The top cap (3) also defines inlets (6A, 7A) for the detonator receiving passage (6) and the detonator lead guide (7). These inlets (6A, 7A) are formed as recesses in the upper surface of the top cap (3). In the embodiment shown the inlets (6A, 7A) are physically separated from one another by a saddle (detonator lead recessed return) (8).

As shown in FIG. 2 the inlet (6) to the detonator receiving passage (6) includes detonator retention means (9) in the form of a series of tabs extending inwardly across the inlet. These tabs allow a detonator (not shown) to be pushed into the detonator receiving passage (6) but then prevent the detonator from being removed from the passage (6).

The body portion (2) also includes a groove (10) and the top cap a corresponding projection (11) that enables the top cap (3) and body portion (2) to be fitted together in the correct orientation noting that the inlets (6A,7A) provided by the top cap (3) must align with the detonator receiving passage (6) and detonator lead guide (7) that extend within the body portion (2) of the shell (1) (the passage and guide are not shown in FIGS. 1 and 2). The body portion (2) may also include ribs (12) to provide enhanced rigidity and in the embodiment shown these ribs are an extension of the groove (10) which engages with the projection (11) of the top cap (3).

Figure 3:
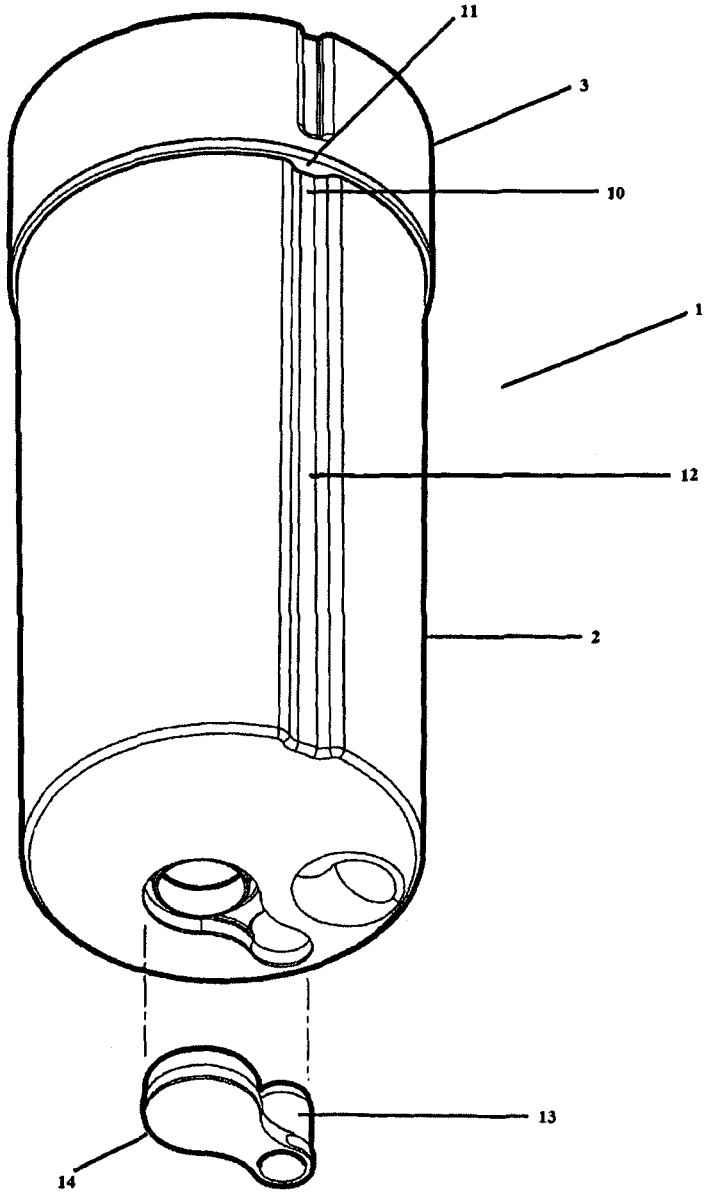

FIG. 3 shows the lower end of the booster shell (1) depicted in FIGS. 1 and 2. In the embodiment shown the lower end of the shell (1) includes an inlet (7B) extending into the detonator lead guide (7). A detonator stop (13) is provided by a bottom bung (14), the with stop (13) extending into the end of the detonator receiving passage (6). The bung (14) is secured into the end of the shell (1) by friction fit. The use of a bung (14) is not mandatory however. In another embodiment the bottom end of the shell (1) may be integrally sealed and the stop provided integral to the end of the detonator receiving passage (6).

Figure 4:
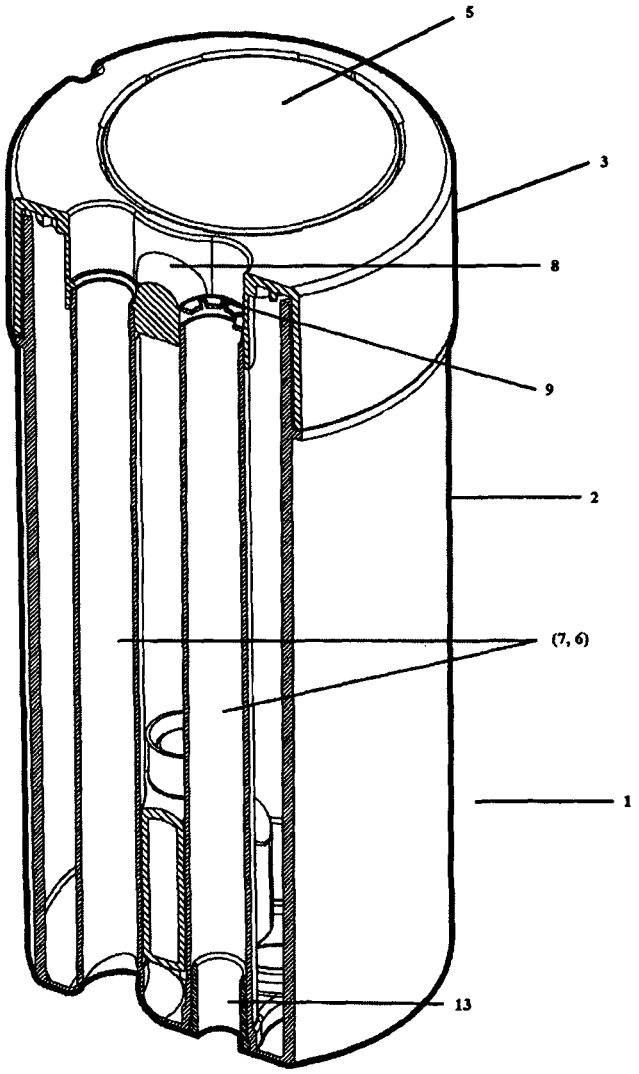

FIG. 4 is a cross-section of the booster shell (1). In addition to features already described in relation to FIGS. 1-3, FIG. 4 shows the detonator receiving passage (6) and detonator lead guide (7). In the embodiment shown the detonator lead guide (7) is sized so as to enable a detonator (not shown) to be pushed into and through the guide (7), as will be discussed further in relation to FIGS. 7-9. The detonator lead guide (7) is open at both ends. The detonator receiving passage (6) is open at the upper end of the shell and closed at the bottom end by the detonator stop provided by the bottom by the bottom bung (14). The embodiment shown also includes a PETN sensitiser bottle (15) that increases initiation sensitivity of the booster. This sensitiser bottle (15) may also allow the booster to be initiated by detonating cord (not shown) positioned in the detonator receiving passage (6). This bottle (15) is capped by a rubber sealing ball (15A) and is shaped so that it fits closely against the end of the detonator receiving passage. The amount of explosive contained in the bottle is typically up to about 15 g, for example from 3 g to 12 g.

Figure 5:
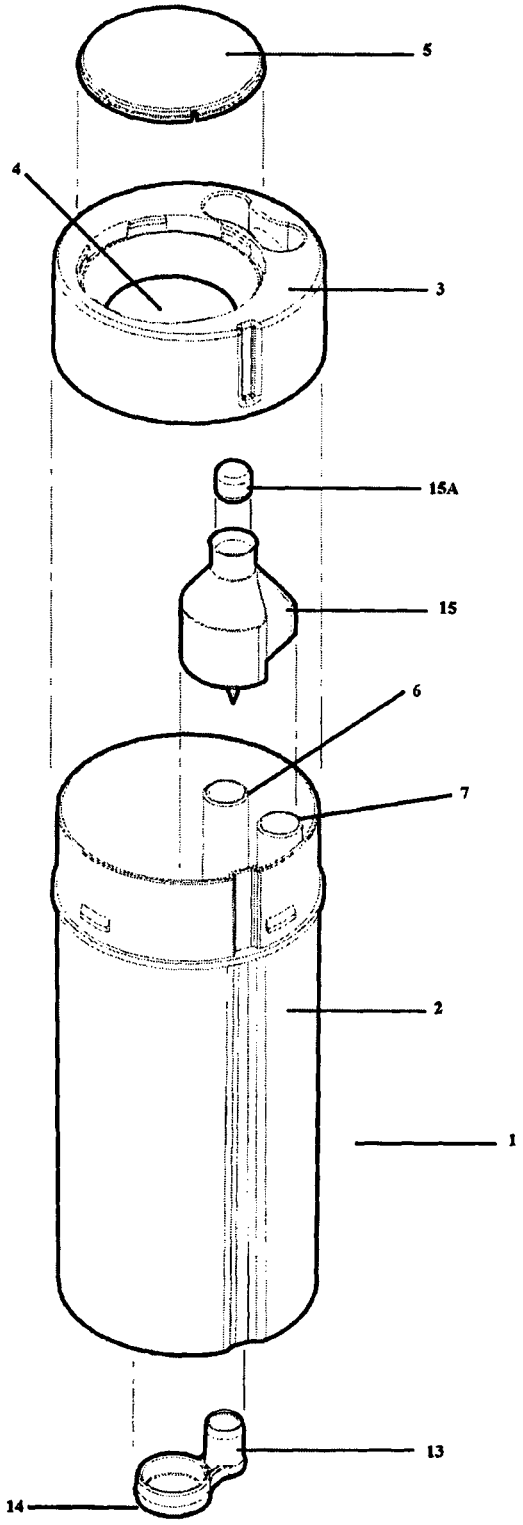

FIG. 5 is an exploded view showing the various components of the booster shell (1). Before filling with (molten) explosive composition the bottom bung (14) is fitted into the lower end of the body portion. A loaded PETN sensitiser bottle (15), sealed with a rubber bung (15), is then located inside the body portion (2) at the lower end thereof. The top cap (3) is then fixed onto the upper end of the body portion (2). The shell (1) is then ready to receive molten explosive composition through the filler port (4) of the top cap (3). After cooling, the filler port bung (5) is then secured in place. The resultant cast booster is then ready to be primed with a detonator, as shown in FIGS. 7-9.

Figure 6:
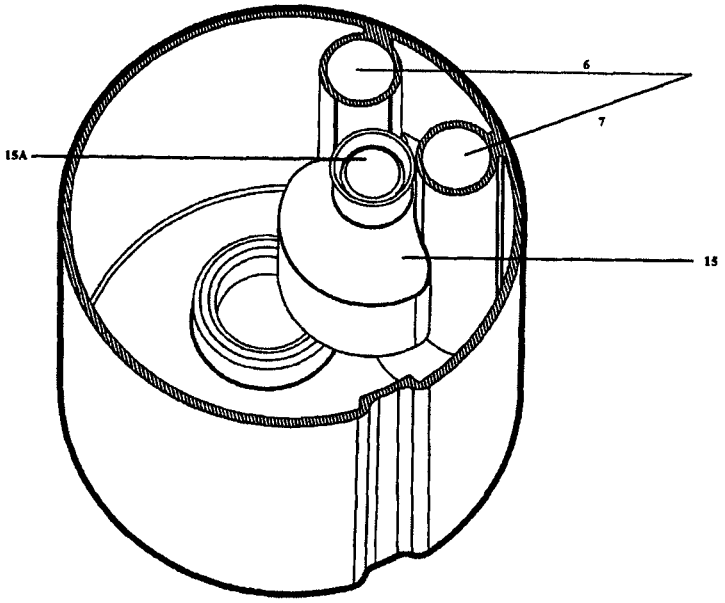

FIG. 6 is a cross-section showing in more detail the arrangement of the PETN sensitiser bottle (15)

Figure 7:
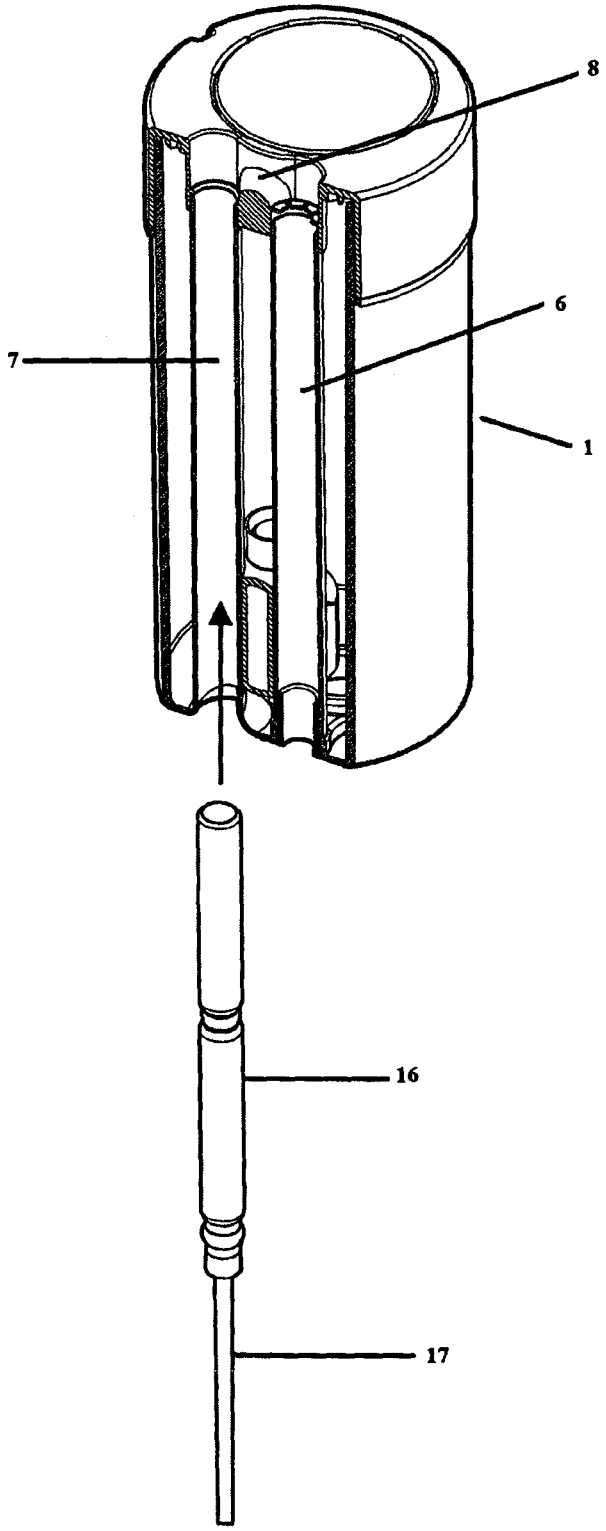
FIGS. 7-9 illustrate priming of a cast booster in accordance with the present invention.
Figure 8:
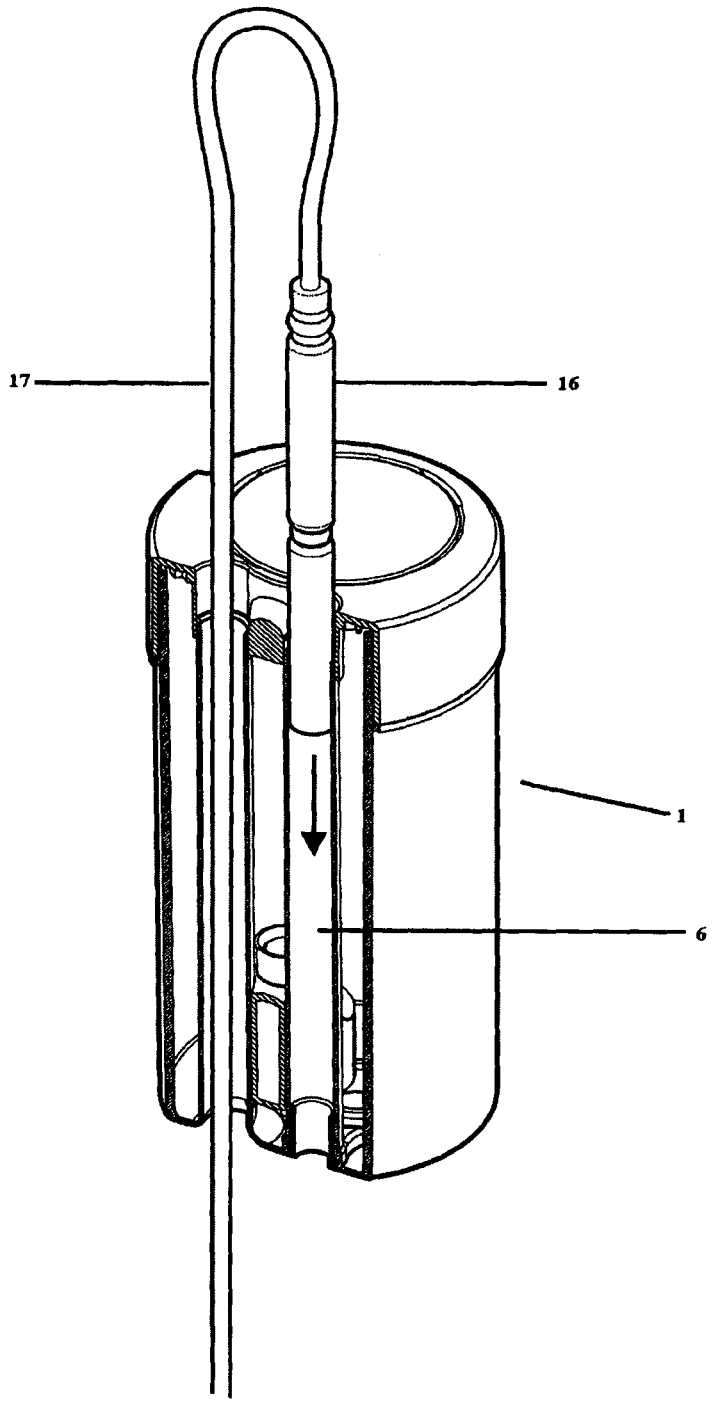
Figure 9:
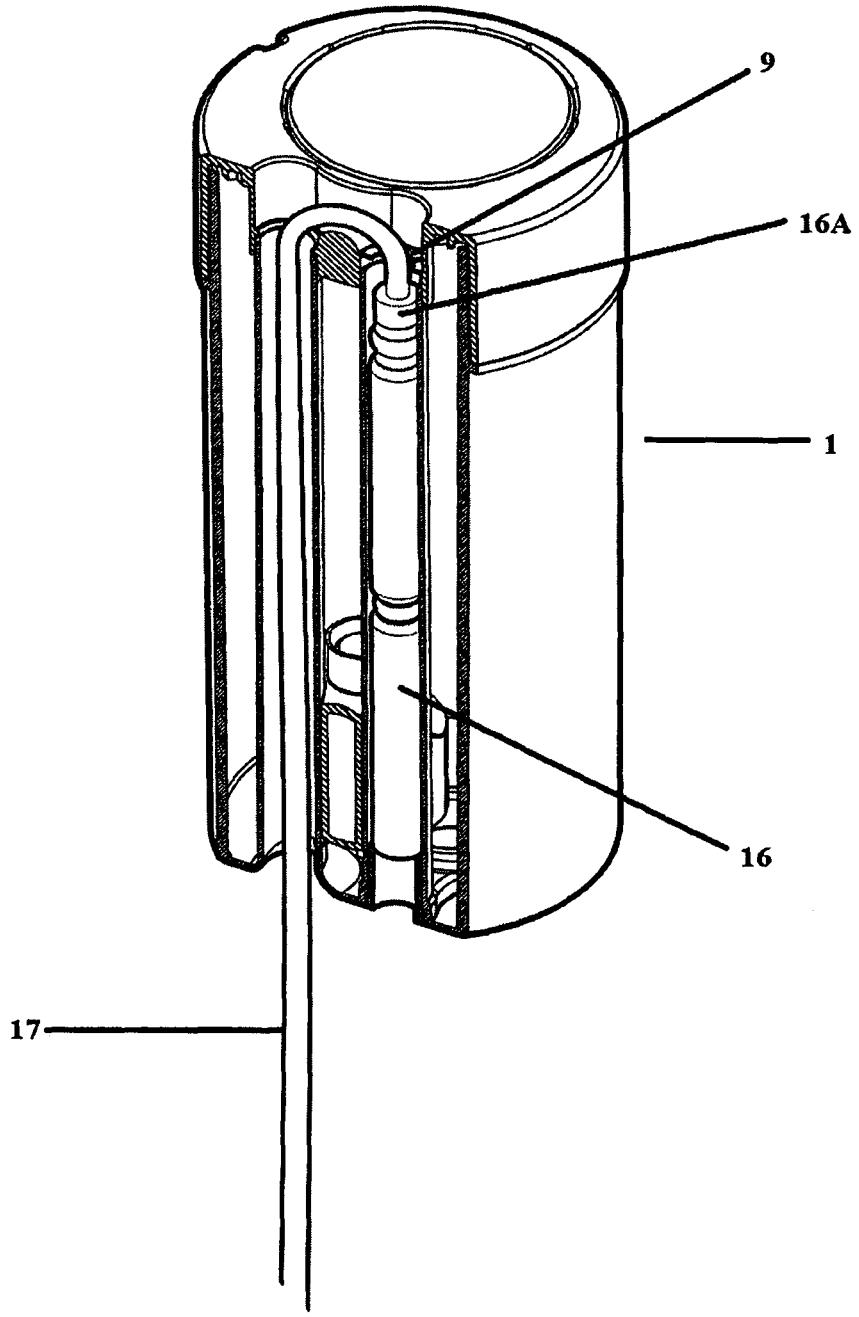
Figure 10:
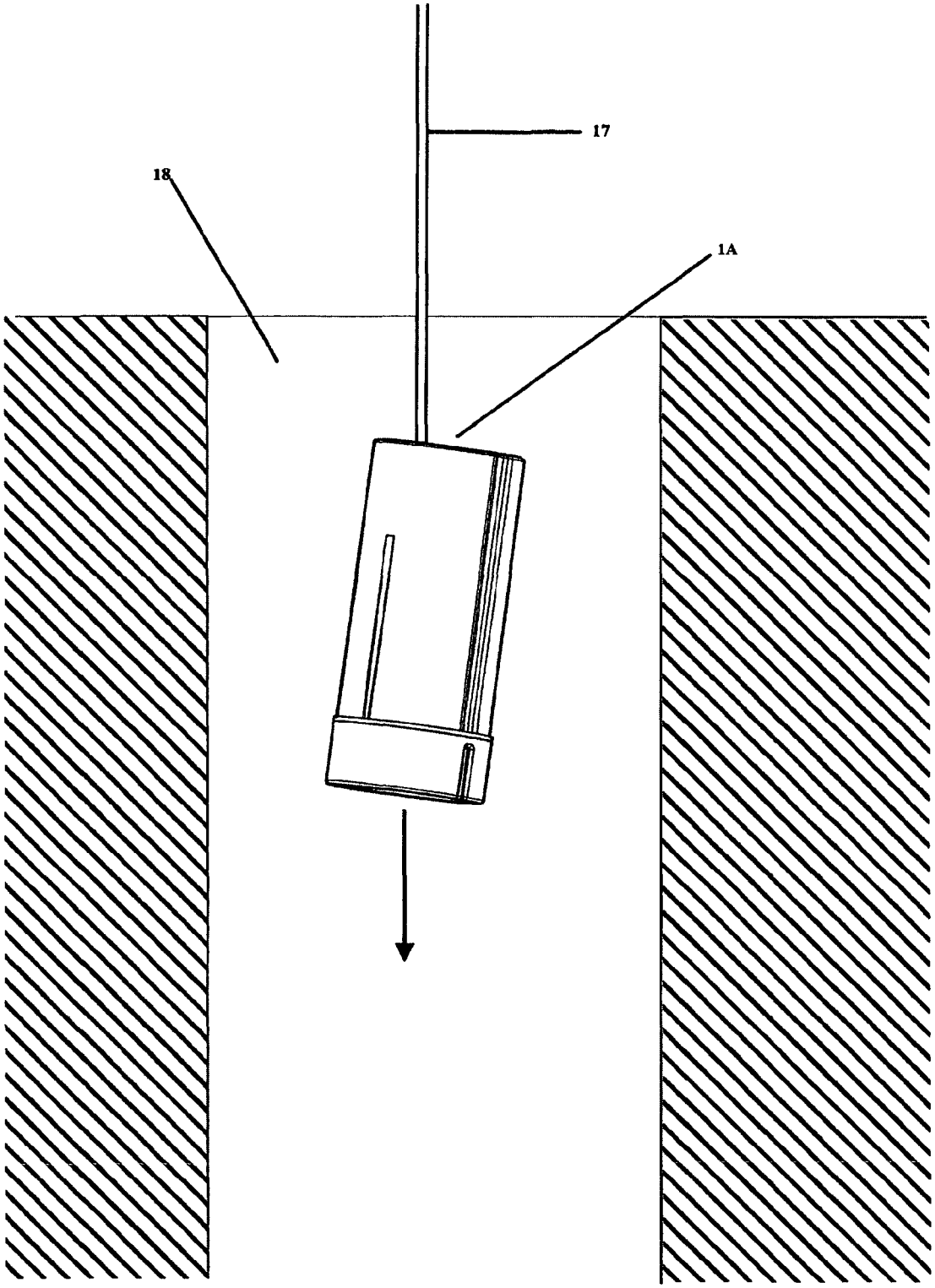
FIG. 10 illustrates loading of a primed booster in accordance with the present invention in a blast hole.

FIGS. 7-9 illustrate priming of a cast booster in accordance with the invention, with the cast booster being shown in part cross-section. In the orientation shown, following solidification of explosive composition in the booster shell (1), any voids in the composition will be located at the upper end of the cast explosive (upper end of the booster). A cartridge-shaped detonator (16) is fed upwardly into and through the detonator lead guide (7; FIG. 7). After emerging from the upper end of the detonator lead guide (7A) the detonator is then pushed downwardly and into the detonator receiving passage (6; FIG. 8) with the detonator lead (17) passing over the saddle (18) provided between the inlets of the detonator receiving passage (6A) and the detonator lead guide (7A). In doing so the tabs of the detonator retention means (9) are deflected downwardly. The detonator (16) is pushed down into the detonator receiving passage (6) until the end of it abuts against the detonator stop (12) provided at the end of the detonator receiving passage (6). At this point the upper end of the detonator (16A) has been pushed beyond the tabs of the detonator retention means (9) with the tabs then deflecting to their original position thereby preventing the detonator (16) form being removed from the passage when the lead (17) of the detonator (16) is tensioned as occurs during blast hole loading (FIG. 10). The base charge of the detonator (16) is located at the lower end of the detonator cartridge (i.e. remote from the end into which the detonator leads run) and in this orientation the base charge will be remote from any voids present in the explosive composition.

FIG. 10 illustrates loading of a blast hole (18) with a primed booster (1A) in accordance with the invention. The booster (1A) is delivered into the blast hole (18) with the upper end (top cap) of the booster (1A) first. In this orientation the detonator lead (17) extends upwardly out of the blast hole (18) from the open end of the detonator lead guide (7). Tensioning of the lead (17) during loading may cause the detonator (16) to be move slightly in the detonator receiving passage (6) but the detonator retention means (9) prevents the detonator (16) from being pulled out of the passage (6). Once suitably positioned in the blast hole (18), bulk explosive (not shown) can be delivered into the blast hole, and this bulk charge initiated by firing of the detonator/booster (16, 1A).

Embodiments of the present invention include the following advantageous design features:

- Access for pouring the booster though the same end as the detonator lead recessed return section, meaning the booster is in an inverted form for pouring.
- The detonator receiving passage and detonator lead guide have open ends at both ends in the main shell moulding. This allows the plastic moulding tooling to be extended through the moulding and rigidly locate at both ends and thereby eliminate deflection of the tooling during the moulding process, which would result in loss on control of the thin walls being achieved.
- The principle of extending tooling through both ends of the moulding may also be achieved with the main body of the moulding, where a smaller hole has been created in the bottom of the main shell. This hole allows support of the moulding die tooling which in turn allows better control over the detonator receiving passage and detonator lead guide wall thickness and also the wall thickness of the main shell walls.
- The part count can been reduced to only two main moulded components (elongate body and top cap), with two minor (low cost) parts in addition (filler port bung and bottom bung with detonator stop).
- The design can be used with a small additional sensitising charge, if desired.

In terms of manufacturing, a major advantage of the design of the present invention is that all of the above features may be incorporated into a simple design with minimal piece count which allows it to be made at reduced cost to other alternative designs.

The invention claimed is:

1. A booster shell, which comprises: an elongate body defining a chamber for an explosive composition, the elongate body having a bottom surface and defining a first upper opening, opposite the bottom surface, for receiving an explosive composition into the chamber;

a detonator receiving passage for receiving a detonator, the detonator receiving passage defining a second upper opening opposite the bottom surface and extending within the chamber from the second upper opening to a detonator stop opposite the second upper opening, the detonator stop being at least one of directly coupled to the bottom surface or integral with the bottom surface such that the second upper opening is the only opening to the detonator receiving passage; a detonator lead guide for receiving a lead of the detonator, the detonator lead guide defining a bottom opening in the bottom surface and a third upper opening opposite the bottom opening.

2. The booster shell of claim 1, wherein:

the detonator receiving passage is integrally formed with the elongate body; and the detonator lead guide is integrally formed with the elongate body.

3. The booster shell of claim 1, wherein the detonator receiving passage is integral with an inner wall of the elongate wall along an entire length of the detonator receiving passage.

4. The booster shell of claim 1, further comprising at least one of a cap or a bung for sealing the first upper opening after the chamber is filled with the explosive composition.

5. The booster shell of claim 1, wherein the detonator stop is integral with the detonator receiving passage.

6. The booster shell of claim 1, further comprising a detonator retainer configured to couple the detonator to the detonator receiving passage to prevent the detonator from unintentionally falling out of the detonator receiving passage.

7. The booster shell of claim 6, wherein the detonator retainer includes a series of resilient tabs that extend inwardly across the detonator receiving passage.

8. The booster shell of claim 1, wherein the detonator lead guide is parallel to the detonator receiving passage.

9. The booster shell of claim 8, further comprising a detonator lead recessed return disposed between the second upper opening and the third upper opening.

10. The booster shell of claim 1, wherein the detonator receiving passage has a size such that the detonator receiving passage can fully enclose a detonator along its length.

11. The booster shell of claim 1, wherein the detonator stop extends at least partially across a diameter of the detonator receiving passage.

12. The booster shell of claim 1 further comprising the explosive composition, the explosive composition having been cast into the chamber through the first upper opening.

13. The booster shell of claim 12, further comprising a sensitizer explosive charge for increasing to increase initiation sensitivity provided in of the booster shell.

14. The booster shell of claim 13, wherein the sensitizer explosive charge is provided in a sealed and thin-walled container.

15. A method comprising delivering molten explosive composition into a chamber of a booster shell via a first upper opening, the booster shell including: an elongate body defining the chamber, the elongate body having a bottom surface and defining the first upper opening opposite the bottom surface, a detonator receiving passage for receiving a detonator, the detonator receiving passage defining a second upper opening opposite the bottom surface and extending within the chamber from the second upper opening to a detonator stop opposite the second upper opening, the detonator stop being at least one of directly coupled to the bottom surface or integral with the bottom surface such that the second upper opening is the only opening to the detonator receiving passage; a detonator lead guide for receiving a lead of the detonator, the detonator lead guide defining a bottom opening in the bottom surface and a third upper opening opposite the bottom opening.

16. The method of claim 15, further comprising of inserting the detonator into the detonator receiving passage via the second upper opening until an end of the detonator abuts against the detonator stop.

17. The booster shell of claim 1, further comprising a bung coupled to the bottom surface, the bung including the detonator stop.

18. The booster shell of claim 1, wherein the detonator stop is configured to abut a first end of a detonator, the first end of the detonator opposite a second end of the detonator having a detonator lead.

19. A booster shell, comprising:

a body portion having a perimeter wall and a bottom wall, the body portion defining a chamber configured to receive an explosive composition poured into the chamber via a first upper opening defined by the perimeter wall, the upper opening opposite the bottom wall;

a detonator passage wall disposed within the perimeter wall, a bottom end of the detonator passage wall being at least one of directly coupled to the bottom wall or integral with the bottom wall such that the detonator passage wall defines a detonator passage mutually exclusive from the chamber, an upper end of the detonator passage wall defining a second upper opening such that a detonator can be inserted into the detonator passage via the second upper opening; and a detonator stop, the detonator stop being at least one of directly coupled to the bottom wall or integral with the bottom wall such that the second upper opening is the only opening to the detonator passage.

20. The booster shell of claim 19, further comprising a top cap configured to be coupled to the perimeter wall, the top cap configured to collectively cover the first upper opening and the second upper opening, the top cap defining a first cap opening such that an explosive composition can be poured into the chamber via the first upper opening and the first cap opening, the top cap defining a second cap opening such that the detonator can be inserted into the detonator passage via the second upper opening and the second cap opening.

21. The booster shell of claim 20, further comprising a filler port bung configured to be coupled to the top cap, the chamber being a closed volume when the top cap is coupled to the perimeter wall and the filler port bung is coupled to the top cap.

* * * * *